US010067465B2

(12) United States Patent
Chen

(10) Patent No.: US 10,067,465 B2
(45) Date of Patent: Sep. 4, 2018

(54) TONER CARTRIDGE AND TRANSMISSION DEVICE THEREOF

(71) Applicant: GENERAL PLASTIC INDUSTRIAL CO., LTD., Taichung (TW)

(72) Inventor: Feng-Chan Chen, Taichung (TW)

(73) Assignee: General Plastic Industrial Co., Ltd., Taichung (TW)

( * ) Notice: Subject to any disclaimer, the term of this patent is extended or adjusted under 35 U.S.C. 154(b) by 0 days.

(21) Appl. No.: 15/584,262

(22) Filed: May 2, 2017

(65) Prior Publication Data

US 2018/0067450 A1 Mar. 8, 2018

(30) Foreign Application Priority Data

Sep. 7, 2016 (CN) ..... 2016 2 1041191 U

(51) Int. Cl.
*G03G 21/16* (2006.01)
*G03G 21/18* (2006.01)
*G03G 15/08* (2006.01)

(52) U.S. Cl.
CPC ..... *G03G 21/1803* (2013.01); *G03G 15/0872* (2013.01); *G03G 21/1864* (2013.01); *G03G 15/0875* (2013.01); *G03G 15/0881* (2013.01); *G03G 15/0896* (2013.01); *G03G 21/1853* (2013.01); *G03G 2215/00987* (2013.01)

(58) Field of Classification Search
CPC ..... G03G 21/1803; G03G 15/0872; G03G 21/1864; G03G 15/0875; G03G 15/0881; G03G 15/0896; G03G 21/1853; G03G 2215/00987
USPC ..... 399/111
See application file for complete search history.

(56) References Cited

U.S. PATENT DOCUMENTS 9,817,333 B2 * 11/2017 Morioka ..... G03G 21/1647
9,846,408 B2 * 12/2017 Ueno ..... G03G 21/185

FOREIGN PATENT DOCUMENTS

JP 11015265 A * 1/1999

* cited by examiner

*Primary Examiner* — Susan Lee
(74) *Attorney, Agent, or Firm* — Muncy, Geissler, Olds & Lowe, P.C.

(57) ABSTRACT

A toner cartridge includes a housing, a photosensitive drum, a connecting unit having a coupling member rotatable about a second imaginary axis, and a linking unit disposed on the photosensitive drum and rotatable about a first imaginary axis. When the coupling member is at a first position, the first and second imaginary axes are not parallel, and the coupling member doesn't contact the linking unit. When the toner cartridge is installed in an electronic imaging device and the coupling member is moved to a second position, the first and second imaginary axes are coaxial, the coupling member and the linking unit are engaged and driven to rotate by the electronic imaging device, thereby transmitting rotary kinetic energy to the photosensitive drum. Because the coupling member is movable between the first and second positions, the toner cartridge is installed in and removed from the electronic imaging device easily and smoothly.

32 Claims, 15 Drawing Sheets

TONER CARTRIDGE AND TRANSMISSION DEVICE THEREOF

BACKGROUND OF THE INVENTION

1. Field of the Invention

The present invention relates to electronic imaging devices and more particularly, to a toner cartridge for an electronic imaging device.

2. Description of the Related Art

With the vigorous development of global industrial information, electronic and information products bring people a quick and convenient life. In this era of information, the electronic imaging devices, such as copy machines, printers and fax machines, are mainly the important equipment to print out computer files and pictures or copy data.

The electronic imaging devices can make copies exactly the same in content with the original handwritten, printed or drawn papers. Therefore, the electronic imaging devices have the modern characteristic of copying papers quickly, saving people much time of transcribing, writing and engraving. In the electronic imaging devices, one of the most important components is the toner cartridge, which is the technical core of the development of the electronic imaging device. At present, many structurally different toner cartridges are available for the user to choose. It is a common goal of the dealers in the related field to make the future design and function of the toner cartridge more perfect.

SUMMARY OF THE INVENTION

The present invention has been accomplished in view of the above-noted circumstances. It is an objective of the present invention to provide a toner cartridge which can be connected with and separated from a driving head of an electronic imaging device easily and smoothly. It is another objective of the present invention to provide a toner cartridge, a coupling member of which has the function of swinging, and will not be protruded out of a housing of the toner cartridge when the toner cartridge is not installed in the electronic imaging device, thereby prevented from damage by the hitting of external objects.

To attain the above objective, the present invention provides a toner cartridge which includes a housing, a photosensitive drum, a connecting unit, and a linking unit. The housing is provided therein with an accommodating space. An end of the housing has an opening communicating with the accommodating space and exterior of the housing. The photosensitive drum is accommodated in the accommodating space of the housing in a way that the photosensitive drum is rotatable about a first imaginary axis. The connecting unit is disposed on the opening of the housing and has a coupling member which is rotatable about a second imaginary axis. The linking unit is disposed on an end of the photosensitive drum and rotatable together with the photosensitive drum. The coupling member is movable between a first position and a second position. When the coupling member is located at the first position, the second imaginary axis is not parallel to the first imaginary axis, and the coupling member is not in contact with the linking unit. When the coupling member is located at the second position, the second imaginary axis is coaxial with the first imaginary axis, and the coupling member and the linking unit are engaged with each other and rotatable together.

When the toner cartridge is installed in an electronic imaging device, the coupling member of the toner cartridge is abutted against a driving head of the electronic imaging device, thereby moved from the first position to the second position. When the coupling member is engaged with the linking unit and the driving head, the coupling member can be driven by the driving head, thereby rotating together with the linking unit. When the toner cartridge is removed from the electronic imaging device, the coupling member of the toner cartridge is no longer abutted against the driving head, thereby moved from the second position to the first position and separated from the linking unit. As a result, the toner cartridge provided by the present invention is connected with and separated from the electronic imaging device easily and smoothly, and the coupling member is prevented from damage by the hitting of external objects when the toner cartridge is not installed in the electronic imaging device.

DETAILED DESCRIPTION OF THE INVENTION

Figure 1:
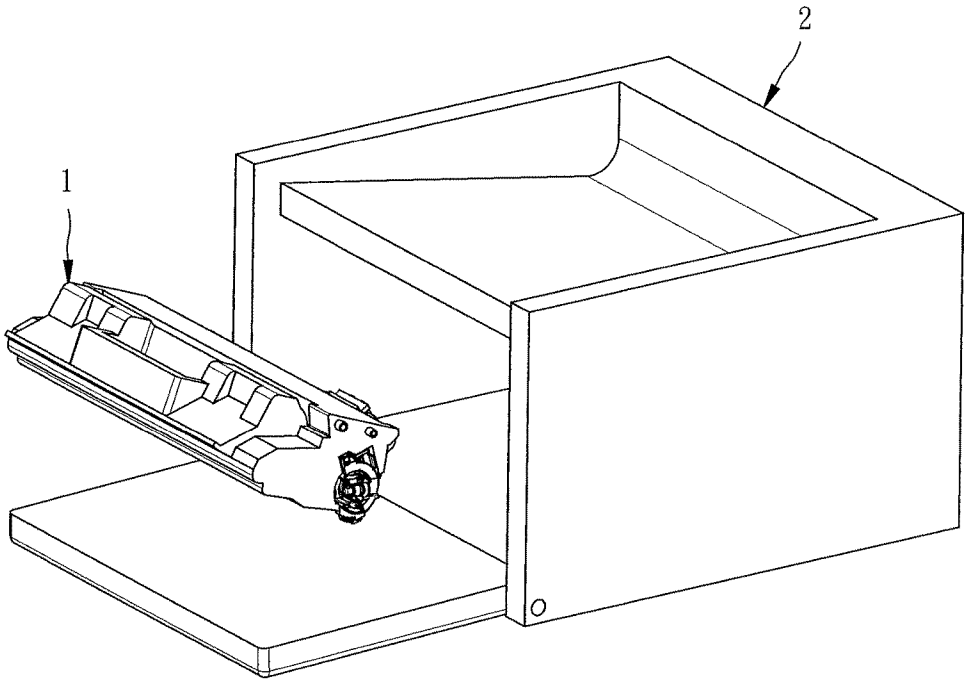
FIG. 1 is a schematic view showing the assembly of an electronic imaging device and a toner cartridge according to a first preferred embodiment of the present invention.
Figure 2:
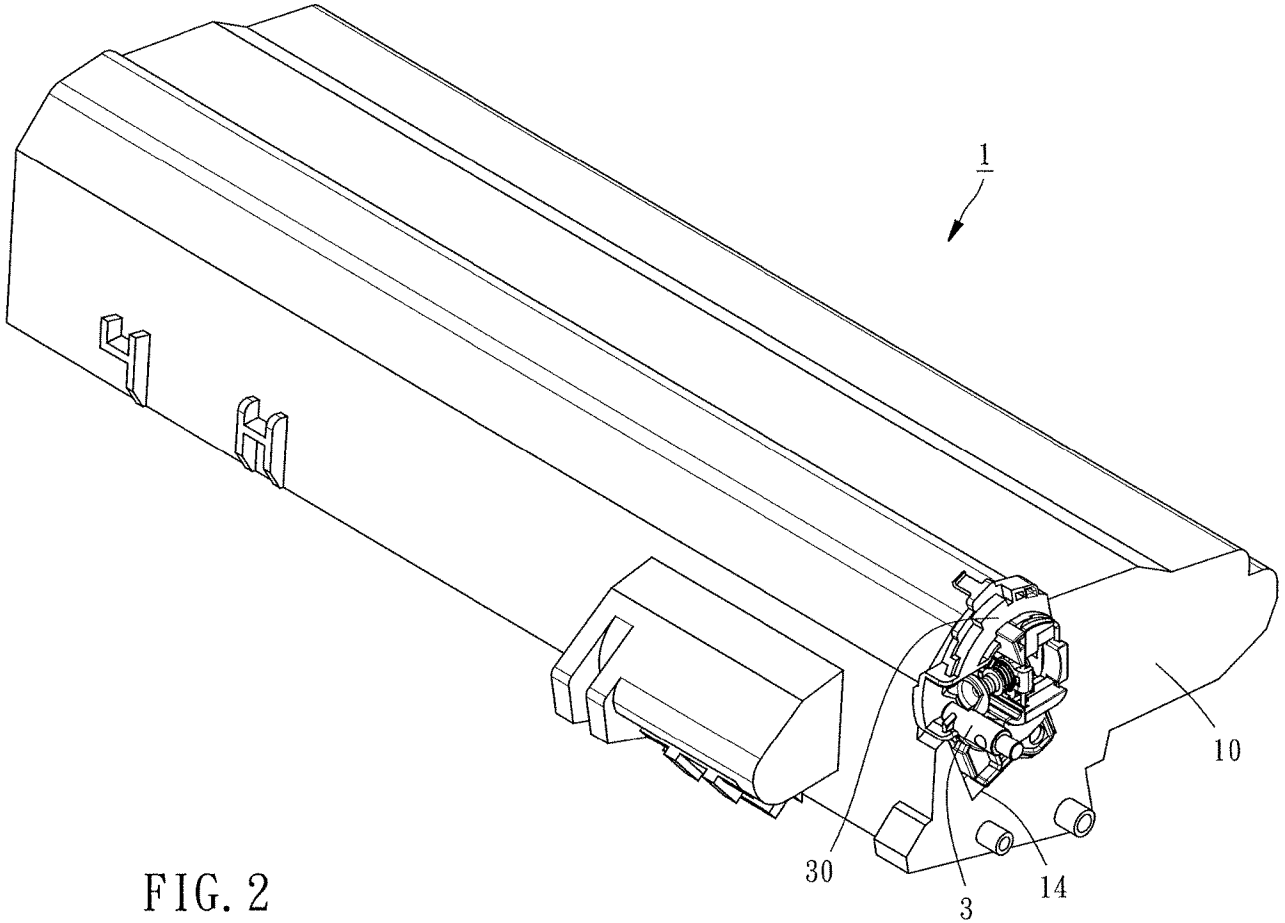
FIG. 2 is an assembled perspective view of the toner cartridge according to the first preferred embodiment of the present invention.
Figure 3:
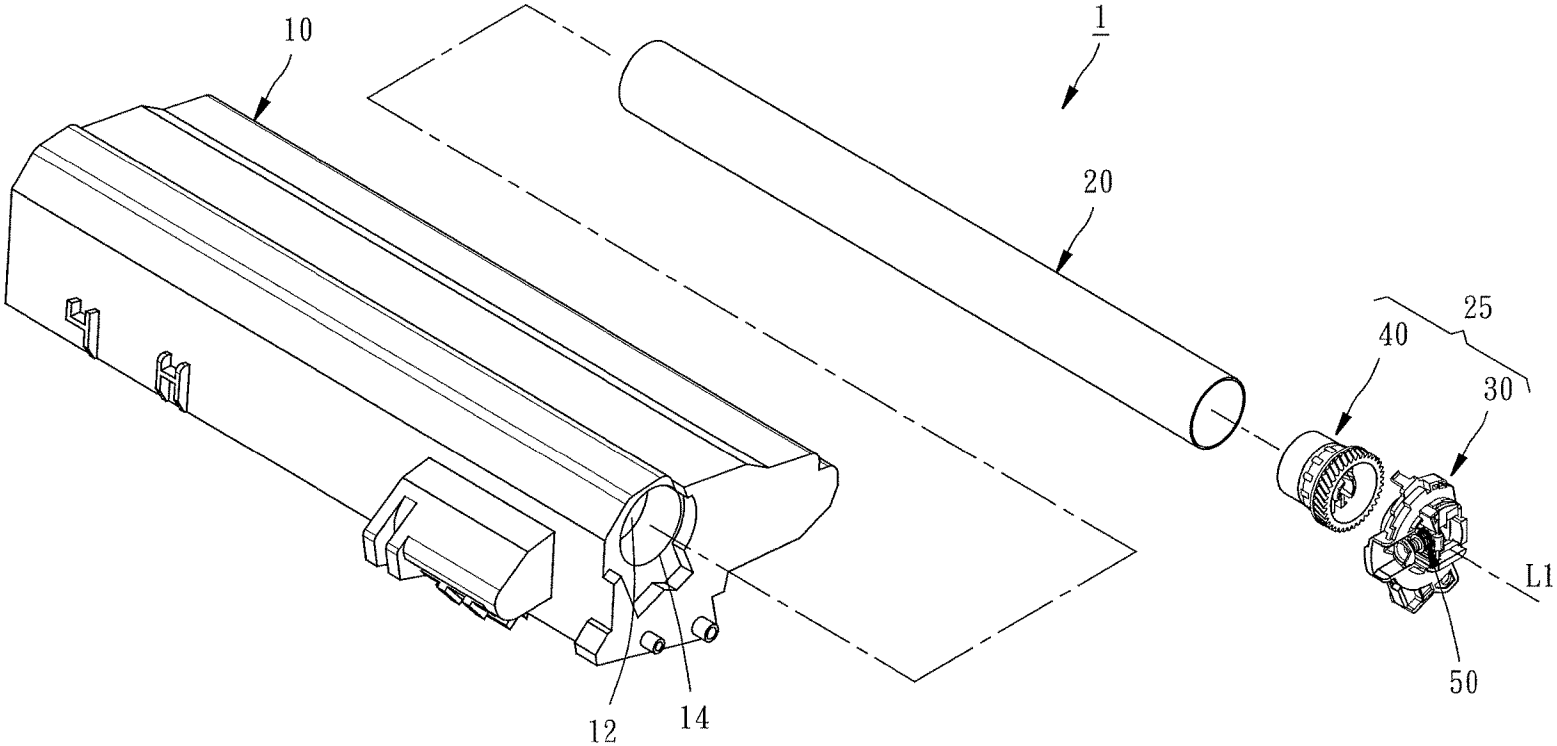
FIG. 3 is an exploded perspective view of the toner cartridge according to the first preferred embodiment of the present invention.

Referring to FIGS. 1-2, a toner cartridge 1 according to a first preferred embodiment of the present invention is adapted to be installed in an electronic imaging device 2. As shown in FIG. 3, the toner cartridge 1 includes a housing 10, a photosensitive drum 20, and a transmission device 25.

The housing 10 is provided therein with an accommodating space 12 for accommodating carbon powders. An end of the housing 10 has an opening 14 communicating with the accommodating space 12 and the exterior of the housing 10.

The photosensitive drum 20 is accommodated in the accommodating space 12 of the housing 10 in a way that the photosensitive drum 20 is rotatable about a first imaginary axis L1.

Figure 4:
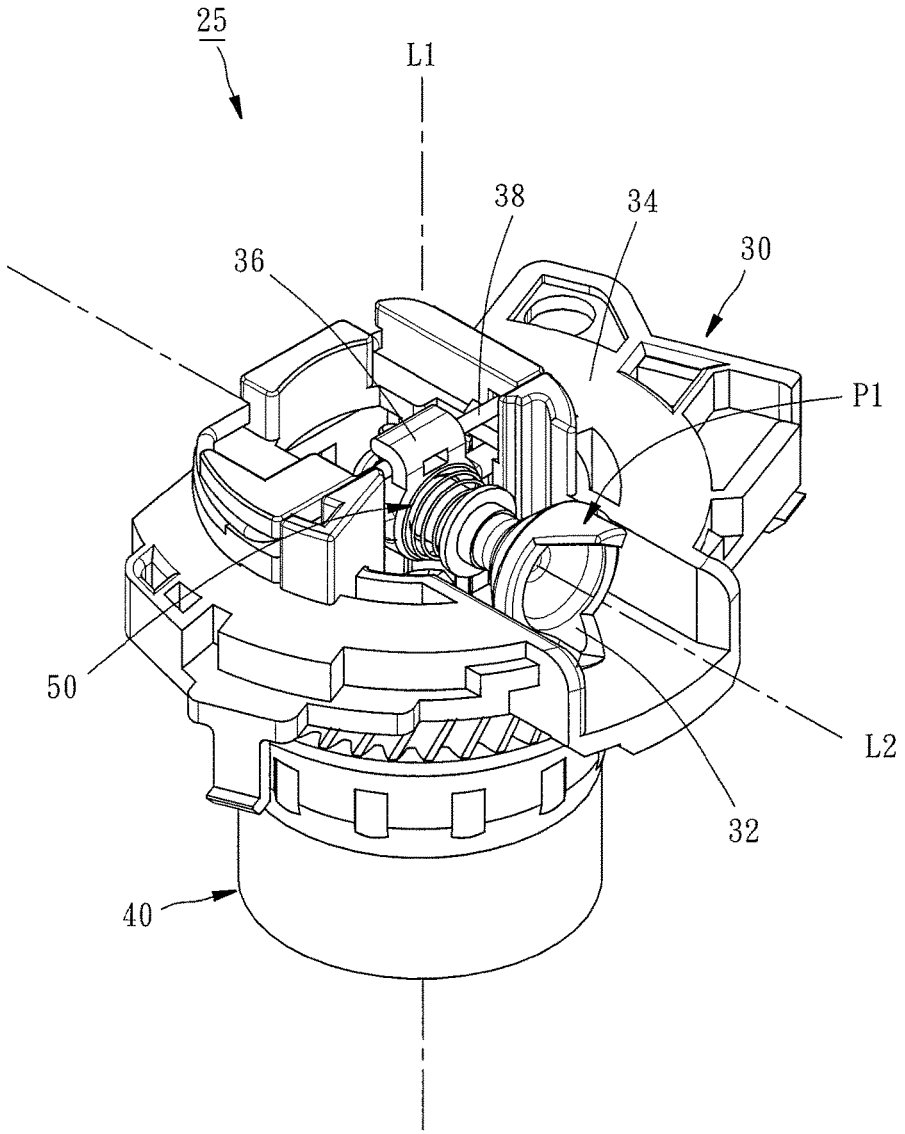
FIG. 4 is an assembled perspective view of a connecting unit and a linking unit according to the first preferred embodiment of the present invention.
Figure 5:
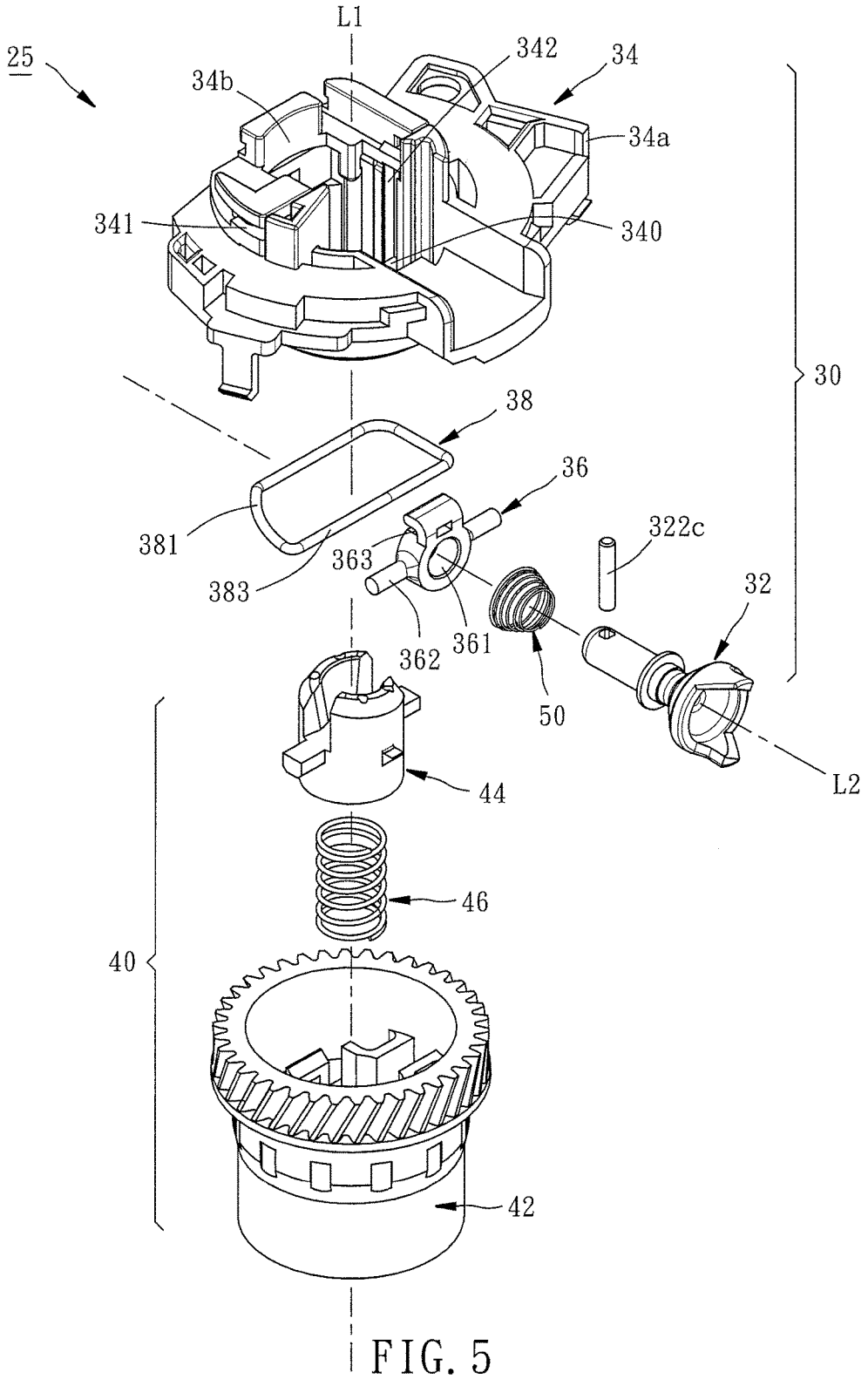
FIG. 5 is an exploded perspective view of the connecting unit and the linking unit according to the first preferred embodiment of the present invention.

The transmission device 25 includes a connecting unit 30 and a linking unit 40. The connecting unit 30 is disposed on the opening 14 of the housing 10. As shown in FIGS. 4-5, the connecting unit 30 has a coupling member 32 rotatable about a second imaginary axis L2, a cover 34 disposed on the opening 14 of the housing 10, an axle seat 36 movably along the second imaginary axis L2 and rotatably disposed on the cover 34, a first elastic member 38 disposed on the cover 34 and connected with the axle seat 36, and a compressed spring 50. The coupling member 32 is disposed on the axle seat 36 and rotatable relative to the axle seat 36. Especially, the coupling member 32 is movable by swinging between a first position P1 and a second position P2. When the coupling member 32 is located at the first position P1, the second imaginary axis L2 is not parallel to the first imaginary axis L1, and the coupling member 32 is not in contact with the linking unit 40. When the coupling member 32 is located at the second position P2, the second imaginary axis L2 is coaxial with the first imaginary axis L1, and the coupling member 32 and the linking unit 40 are engaged with each other and rotatable together. In this embodiment, the coupling member 32 shown in FIG. 4 is located at the first position P1. At this time, the second imaginary axis L2 is approximately perpendicular to the first imaginary axis L1. The details about the second position P2 will be specified in the following description.

Figure 6:
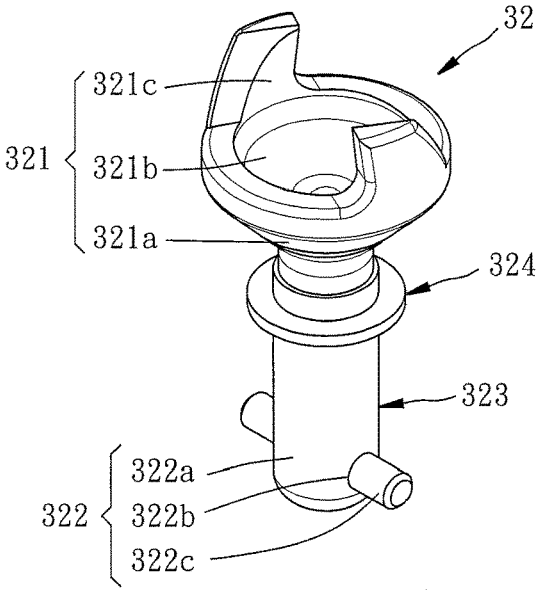
FIG. 6 is a perspective view of a coupling member according to the first preferred embodiment of the present invention.
Figure 7:
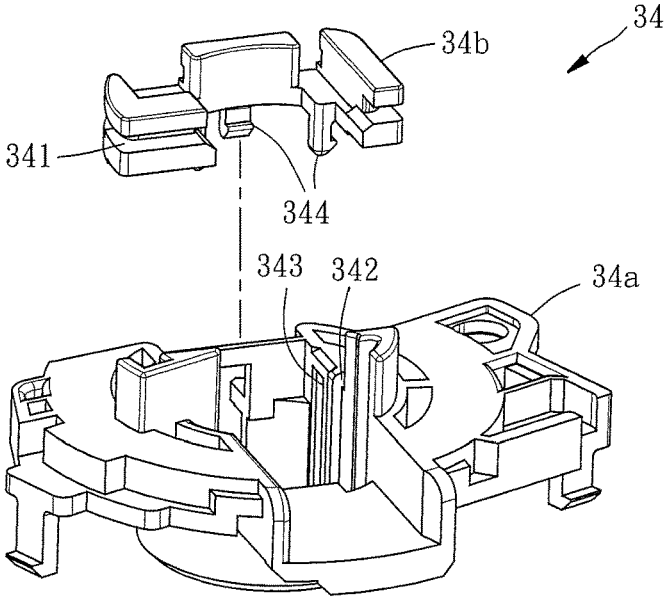
FIG. 7 is an exploded perspective view of a cover according to the first preferred embodiment of the present invention.

The structure of the connecting unit 30 of this embodiment can be further understood by reference to FIGS. 5-7. As shown in FIG. 6, the coupling member 32 has a rotary force receiving portion 321, a rotary force transmitting portion 322, an axial portion 323 connecting the rotary force receiving portion 321 with the rotary force transmitting portion 322, and a stopping portion 324 extended from the axial portion 323 radially. The rotary force receiving portion 321 of the coupling member 32 includes a cone-shaped main body 321*a*, a central recess 321*b* located on a side of the main body 321*a* opposite to the axial portion 323, and two engaging pillars 321*c* extended from the side of the main body 321*a* opposite to the axial portion 323 and located by two sides of the central recess 321*b*. The rotary force transmitting portion 322 of the coupling member 32 includes a central axle 322*a* connected with the axial portion 323, a radial hole 322*b* passing through the central axle 322*a*, and a pin 322*c* inserted through the radial hole 322*b*, wherein two ends of the pin 322*c* are protruded out of the radial hole 322*b*. In other embodiments, the rotary force receiving portion 321 and the rotary force transmitting portion 322 of the coupling member 32 may be modified in structure, as long as they can receive rotary force and transmitting rotary force respectively.

As shown in FIGS. 5 and 7, the cover 34 is provided at the center thereof with a passage 340 extended along the first imaginary axis L1 for the axial portion 323 of the coupling member 32 located at the second position P2 to be inserted through the passage 340. The cover 34 has a main body 34*a* and a sub-body 34*b* connected with the main body 34*a*. The sub-body 34*b* is curved or U-shaped and located by the passage 340. The sub-body 34*b* is provided on the periphery thereof with a groove 341. The cover 34 has two sliding grooves 342 provided on two sides of the passage 340 and extended parallel to the first imaginary axis L1. The axle seat 36 is provided on two sides thereof with two protruded columns 362. The two protruded columns 362 are inserted in the two sliding grooves 342 to enable the axle seat 36 to move and rotate relative to the cover 34. In this embodiment, the main body 34*a* has three engaging concave portions 343, and the sub-body 34*b* has three engaging hooks 344 which can be engaged with the engaging concave portions 343 respectively, so that the main body 34*a* and the sub-body 34*b* are detachably connected with each other. However, in other embodiments, the manner of connecting the main body 34*a* with the sub-body 34*b* may be modified depending on the situation. The main body 34*a* and the sub-body 34*b* may be even connected integrally.

The first elastic member 38 applies a force to the axle seat 36 to enable the coupling member 32 to move back to the first position P1 from another position such as the second position P2. The first elastic member 38 is a loop-shaped silicone rubber ring, having a noose portion 381 and a spanning portion 383. The noose portion 381 is put around the cover 34 and put in the groove 341 of the sub-body 34*b*. The spanning portion 383 is bridged between two ends of the sub-body 34*b*, thereby spanning the passage 340. Besides, the spanning portion 383 is connected with the axle seat 36. The first elastic member 38 is originally shaped as a circular ring, and shaped as shown in FIG. 5 after being put around the sub-body 34*b*. In other embodiments, the shape of the first elastic member 38 may be modified according to requirements. For example, the first elastic member 38 may be elongated. In such case, the first elastic member 38 is arranged to span the passage 340 in a way that two ends of the first elastic member 38 are connected with the cover 34, and the center of the first elastic member 38 is connected with the axle seat 36. Alternately, other structures may be substituted for the first elastic member 38, as long as they can apply a force to the axle seat 36 to enable the coupling member 32 to move back to the first position P1.

Figure 8:
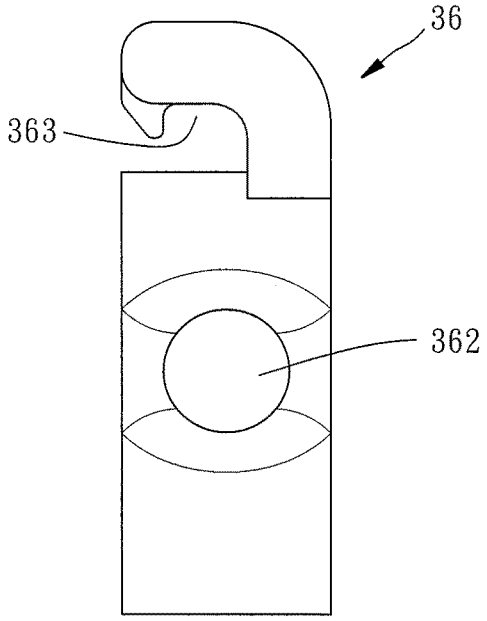
FIG. 8 is a lateral view of an axle seat according to the first preferred embodiment of the present invention.

As shown in FIGS. 5 and 8, the axle seat 36 is provided at the center thereof with an axial hole 361 for the axial portion 323 of the coupling member 32 to be inserted through the axial hole 361. The axle seat 36 has an accommodating groove 363 for accommodating the spanning portion 383 of the first elastic member 38. In other embodiments, the configuration of the connection of the axle seat 36 with the first elastic member 38 may be modified according to requirements.

The compressed spring 50 is sleeved onto the axial portion 323 of the coupling member 32, and two ends of the compressed spring 50 are abutted against the stopping portion 324 and the axle seat 36. The compressed spring 50 enables the coupling member 32 to displace in a predetermined stroke relative to the axle seat 36. In this way, the coupling member 32 can swing between the first position P1 and the second position P2 relatively more smoothly. In this embodiment, the compressed spring 50 is approximately cone-shaped. An end of the compressed spring 50, which has smaller diameter, is abutted against the stopping portion 324. The other end of the compressed spring 50, which has larger diameter, is abutted against the axle seat 36. However, in other embodiments, the compressed spring 50 is unlimited to cone-shaped. The coupling member 32 may even have no such stopping portion 324, and in such case an end of the compressed spring 50 is abutted against the bottom edge of the rotary force receiving portion 321.

The linking unit 40 is disposed on an end of the photosensitive drum 20, and located between the photosensitive drum 20 and the connecting unit 30. The linking unit 40 is rotatable about the first imaginary axis L1 together with the photosensitive drum 20. The linking unit 40 has a gear 42 disposed on an end of the photosensitive drum 20, an engaging member 44 disposed on the gear 42 and movable along the first imaginary axis L1 relative to the gear 42, and a second elastic member 46 disposed between the gear 42 and the engaging member 44. The second elastic member 46 applies a force toward the connecting unit 30 to the engaging member 44 to enable the engaging member 44 to be engaged with the coupling member 32 located at the second position P2.

Figure 9:
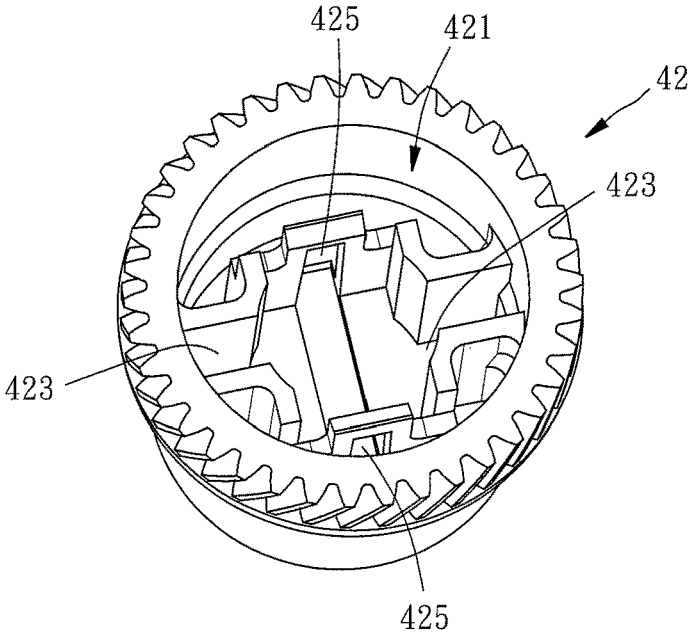
FIG. 9 is a perspective view of a gear according to the first preferred embodiment of the present invention.
Figure 10:
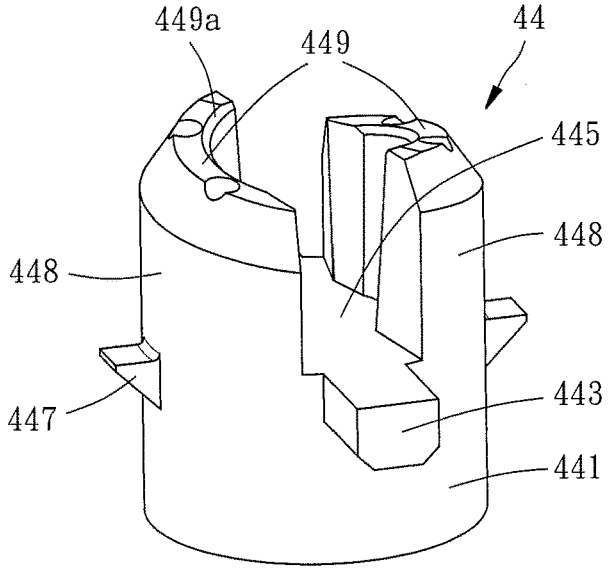
FIG. 10 is a perspective view of an engaging member according to the first preferred embodiment of the present invention.
Figure 11:
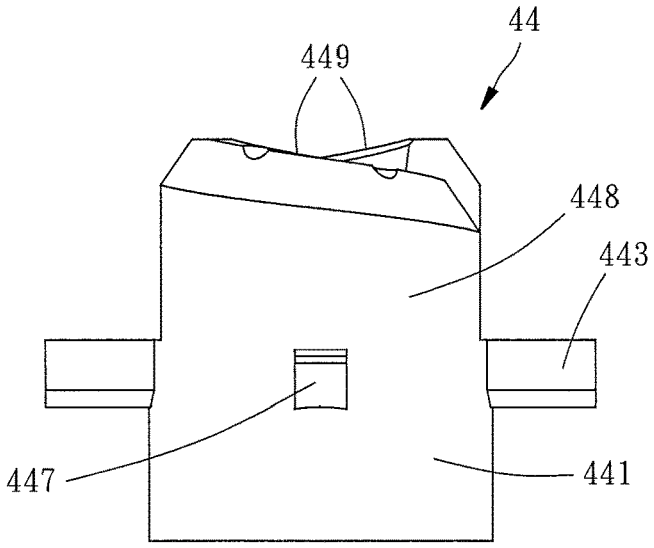
FIG. 11 is a lateral view of the engaging member according to the first preferred embodiment of the present invention.
Figure 12:
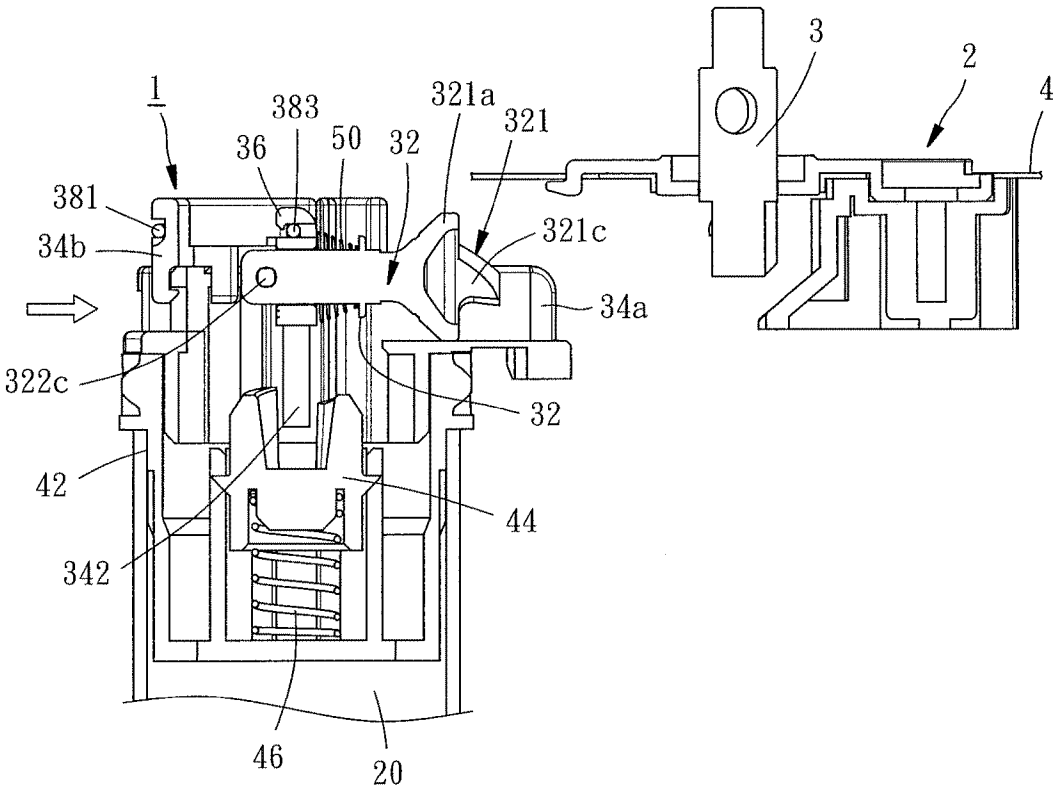
FIGS. 12-16 are sectional views showing the process that the toner cartridge according to the first preferred embodiment of the present invention is connected with a driving head.
Figure 13:
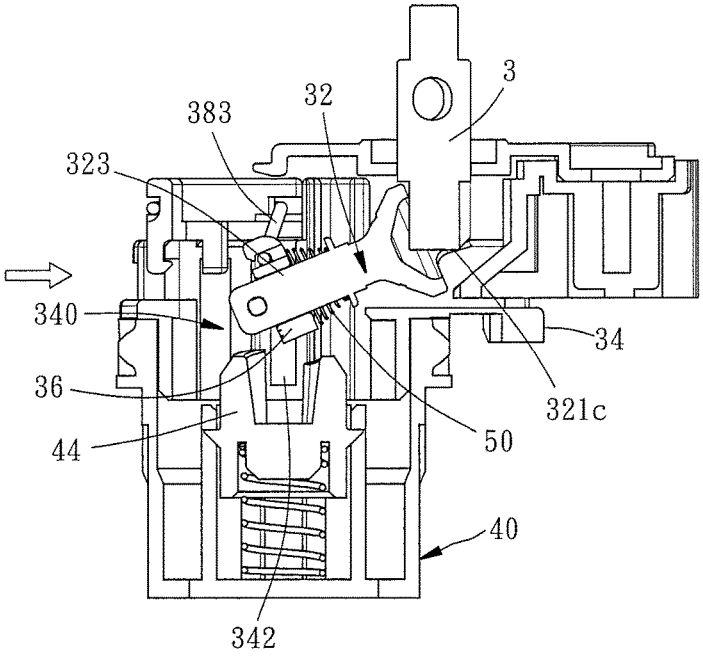

Referring to FIG. 9, the gear 42 has an accommodating portion 421 for accommodating the engaging member 44 and the second elastic member 46, two elongated grooves 423 provided on two sides of the accommodating portion 421 and extended parallel to the first imaginary axis L1, and two limiting grooves 425 provided on two other sides of the accommodating portion 421. Referring to FIGS. 10-11, the engaging member 44 has a main body 441, two transmitting arms 443 extended from two sides of the main body 441, and two protruded hooks 447 extended from the main body 441 and inserted in the two limiting grooves 425. The top end of the second elastic member 46 is abutted on the bottom of the main body 441. The two transmitting arms 443 are inserted in the two elongated grooves 423 to enable the engaging member 44 to move along the first imaginary axis L1 relative to the gear 42 and disable the engaging member 44 from rotating relative to the gear 42. The two limiting grooves 425 and the two protruded hooks 447 are engaged with each other, thereby preventing the engaging member 44 from being separated from the gear 42. The main body 441 of the engaging member 44 has an embedding groove 445 located on a side of the main body 441 opposite to the second elastic member 46, i.e. the side relatively closer to the connecting unit 30, and two arched walls 448 located by two sides of the embedding groove 445. When the coupling member 32 is located at the second position P2, the rotary force transmitting portion 322 is inserted in the embedding groove 445 so that the coupling member 32 and the engaging member 44 are engaged with each other and rotatable together. Each of the arched walls 448 has a guiding end surface 449 facing the axle seat 36. Each guiding end surface 449 is provided on a side thereof adjacent to the embedding groove 445 with a chamfer 449*a*. The pin 322*c* of the coupling member 32 can be abutted on the two guiding end surfaces 449. It is observable from the visual angle of FIG. 10 that the two arched walls 448 are approximately spiral. Especially it can be known from FIG. 11 that there is a drop between two ends of each guiding end surface 449 so that the two guiding end surfaces 449 are inclined. Such configuration design will make the rotary force transmitting portion 322 of the coupling member 32 relatively easier to be inserted into the embedding groove 445, the process of that will be detailed in the following content.

It should be mentioned that the engaging member 44 and the gear 42 may have different structures from the structures described above, and may be connected with each other by other manners, as long as the engaging member 44 is movable along the first imaginary axis L1 relative to the gear 42 but unrotatable relative to the gear 42.

Figure 14:
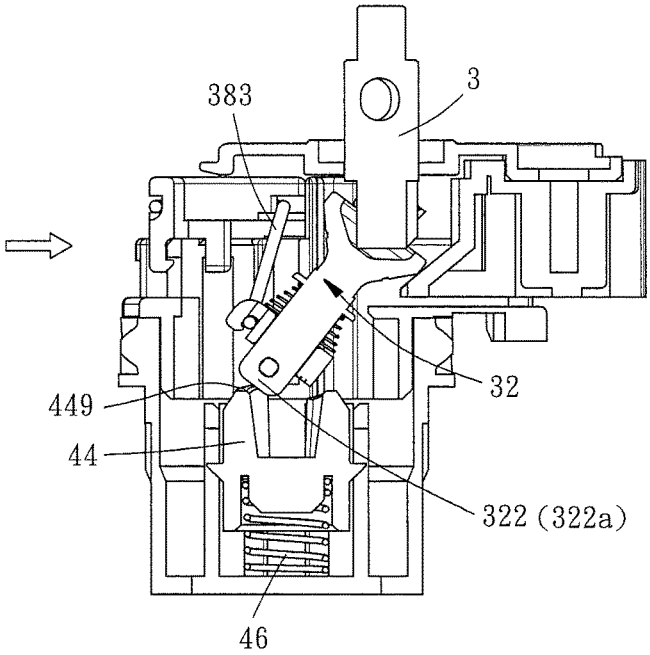
Figure 15:
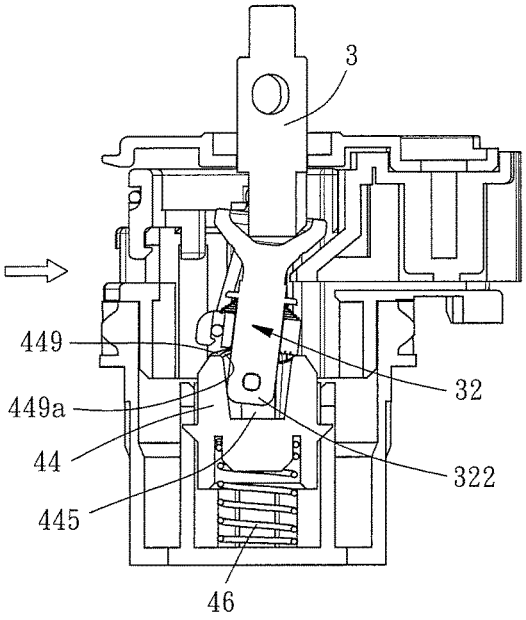
Figure 16:
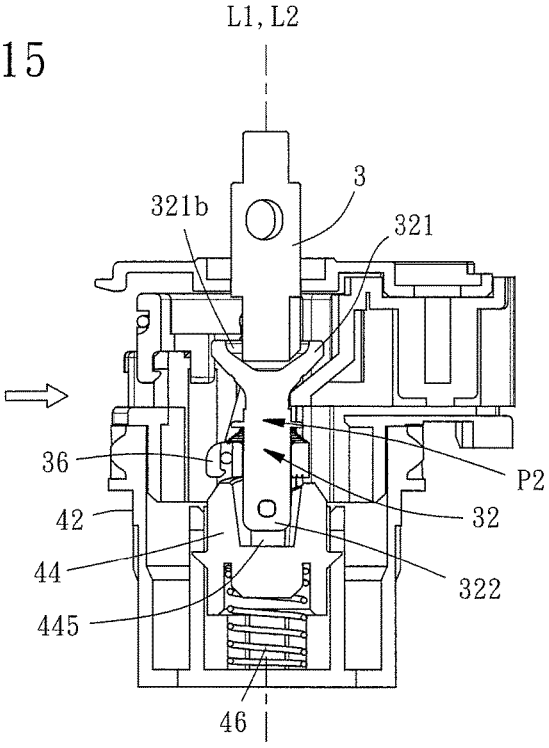

Refer to FIGS. 12-16, which show the process that the toner cartridge 1 is connected with a driving head 3 of the electronic imaging device 2. The driving head 3 is rotatably disposed on an inner wall 4 of the electronic imaging device 2. When the toner cartridge 1 is installed into the electronic imaging device 2, the toner cartridge 1 is moved in the direction pointed by the arrow shown in FIGS. 12-16, and the connecting unit 30 will be connected with the driving head 3. Specifically speaking, one of the engaging pillars 321*c* of the coupling member 32 may be firstly in contact with the driving head 3, or it may be the main body 321*a* that firstly contacts the driving head 3, depending on the angle of the coupling member 32. In either condition, the rotary force receiving portion 321 of the coupling member 32 is pushed by the driving head 3. With the toner cartridge 1 continuously being moved to the right in FIG. 13, the coupling member 32 pushed by the driving head 3 overcomes the elastic force of the compressed spring 50 and start to displace to the left. On the other hand, the axle seat 36 is moved toward the linking unit 40, i.e. moved downwardly in FIG. 13, in a way that the two protruded columns 362 slide along the two sliding grooves 342. It is resulted from that the coupling member 32 is rotated and applies a force to the lower left to the axle seat 36 through the compressed spring 50, causing the axle seat 36 to move downwardly. At the same time, the coupling member 32 and the axle seat 36 push the spanning portion 383 of the first elastic member 38 so that the coupling member 32 and the axle seat 36 swing and rotate together. At this time, the spanning portion 383 starts to be deformed, and the axial portion 323 of the coupling member 32 is inserted through the passage 340 of the cover 34. As shown in FIG. 14, when the toner cartridge 1 is continuously moved to the right and causes the coupling member 32 to continuously swing counterclockwise, the central axle 322*a* of the rotary force transmitting portion 322 of the coupling member 32 contacts and pushes the engaging member 44, so that the engaging member 44 overcomes the elastic force of the second elastic member 46 and moves downwardly in FIG. 14. After that, as shown in FIG. 15, the rotary force transmitting portion 322 slides over the guiding end surface 449 and the chamfer 449*a* and then inserted into the embedding groove 445 of the engaging member 44. When the coupling member 32 swings to the position where the rotary force transmitting portion 322 is completely inserted in the embedding groove 445 as shown in FIG. 16, the coupling member 32 has swung for about 90 degrees. At this time, the second imaginary axis L2 is coaxial with the first imaginary axis L1, and the coupling member 32 and the engaging member 44 are engaged with each other and thereby rotatable together. In fact, when the coupling member 32 is inserted in the embedding groove 445, the coupling member 32 no longer pushes the engaging member 44. At this time, the elastic force of the second elastic member 46 causes the engaging member 44 to displace toward the driving head 3 and pushes the axle seat 36, thereby moving the coupling member 32 upwardly in FIG. 16 to the second position P2, so that the terminal end of the driving head 3 is accommodated in the central recess 321*b* of the rotary force receiving portion 321, and the two engaging pillars 321*c* (unobservable from the visual angle of FIG. 16) of the coupling member 32 are engaged with two driving ribs (not shown) of the driving head 3. In this way, the coupling member 32 can be driven to rotate by the driving head 3 and drive the engaging member 44 to rotate by the rotary force transmitting portion 322. The engaging member 44 can drive the gear 42 to rotate by the two transmitting arms 443 (unobservable from the visual angle of FIG. 16). As a result, the rotary kinetic energy of the driving head 3 can be transmitted to the photosensitive drum 20 which can conduct electricity when photosensitized and attract carbon powders at the same time to develop the to-be-printed document.

Figure 17:
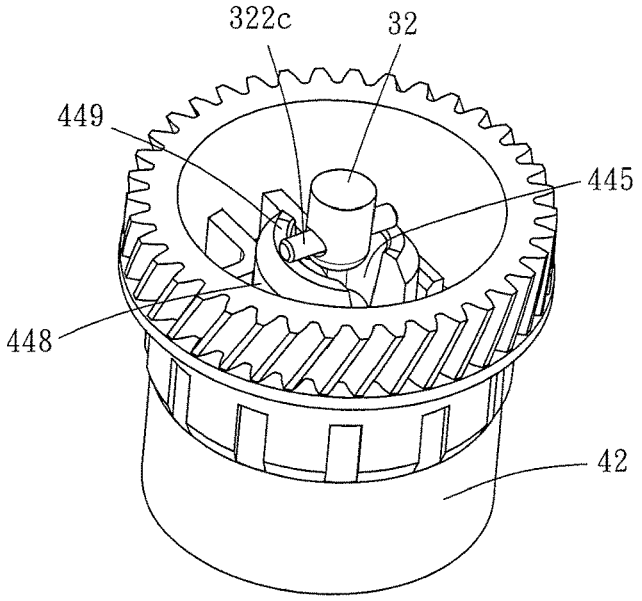
FIGS. 17-18 are schematic views of a part of the toner cartridge according to the first preferred embodiment of the present invention.
Figure 18:
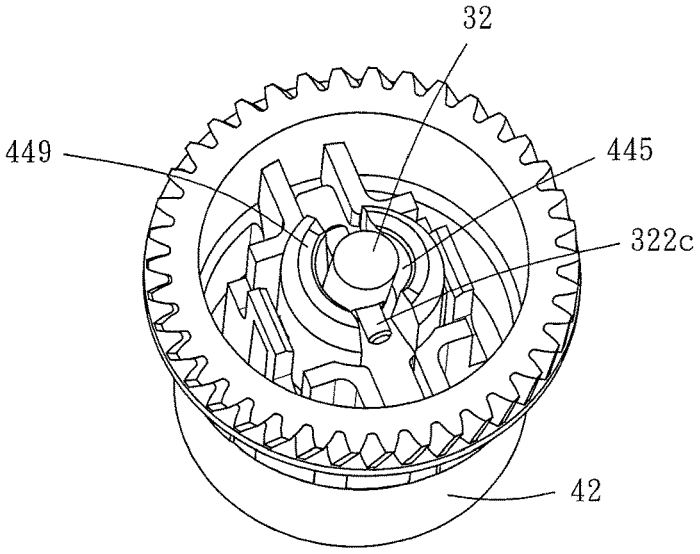
Figure 19:
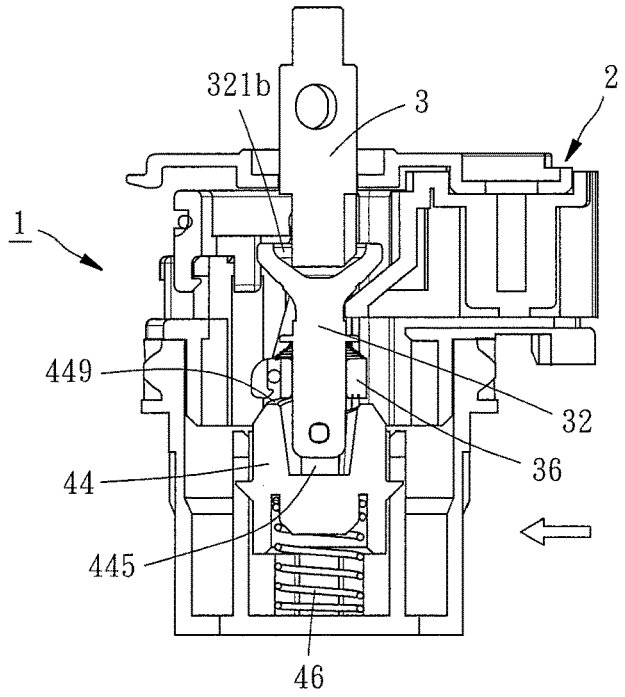
FIGS. 19-24 are sectional views showing the process that the toner cartridge according to the first preferred embodiment of the present invention is separated from the driving head.

In fact, in the process that the coupling member 32 swings from the first position P1 to the second position P2, when the rotary force transmitting portion 322 starts to be inserted into the embedding groove 445, the pin 322*c* of the rotary force transmitting portion 322 may be unable to be accommodated in the embedding groove 445, but abutted on the arched walls 448 of the engaging member 44 as shown in FIG. 17, because of the angle of the pin 322*c*. At this time, the driving head 3 driving the coupling member 32 to rotate counterclockwise makes two ends of the pin 322*c* slide downwardly on the two guiding end surfaces 449. When the coupling member 32 is rotated to the position where the pin 322*c* is approximately parallel to the embedding groove 445, the engaging member 44 is pushed toward the coupling member 32 by the elastic force of the second elastic member 46, so that the pin 322*c* is inserted in the embedding groove 445 as shown in FIG. 18. Specifically speaking, the configuration design of the two guiding end surfaces 449 makes the coupling member 32 relatively easier to be inserted in the embedding groove 445.

Figure 20:
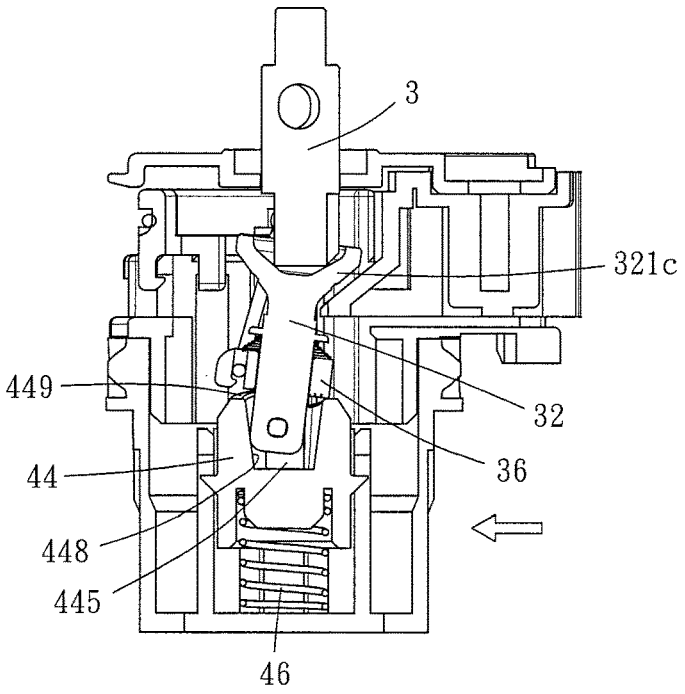
Figure 21:
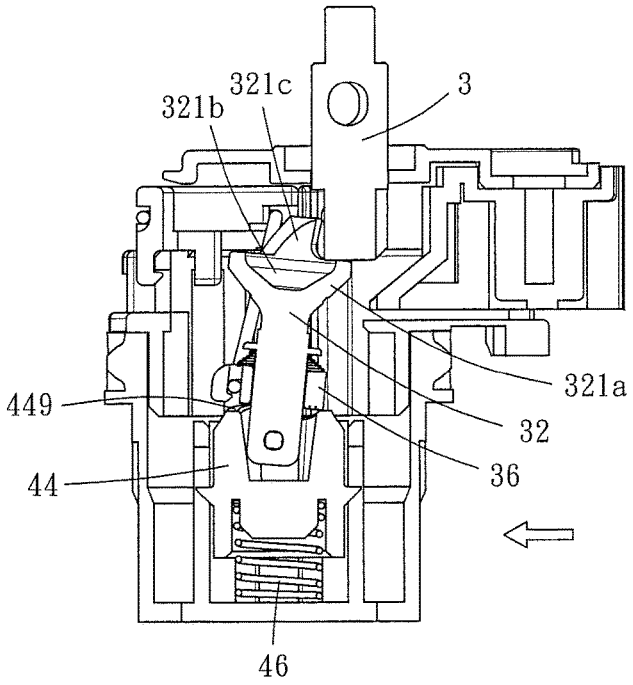
Figure 22:
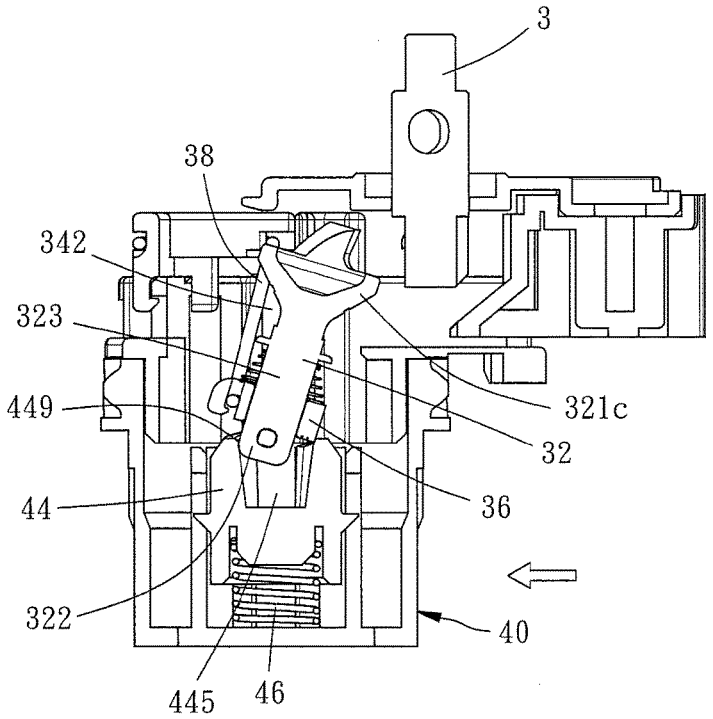
Figure 23:
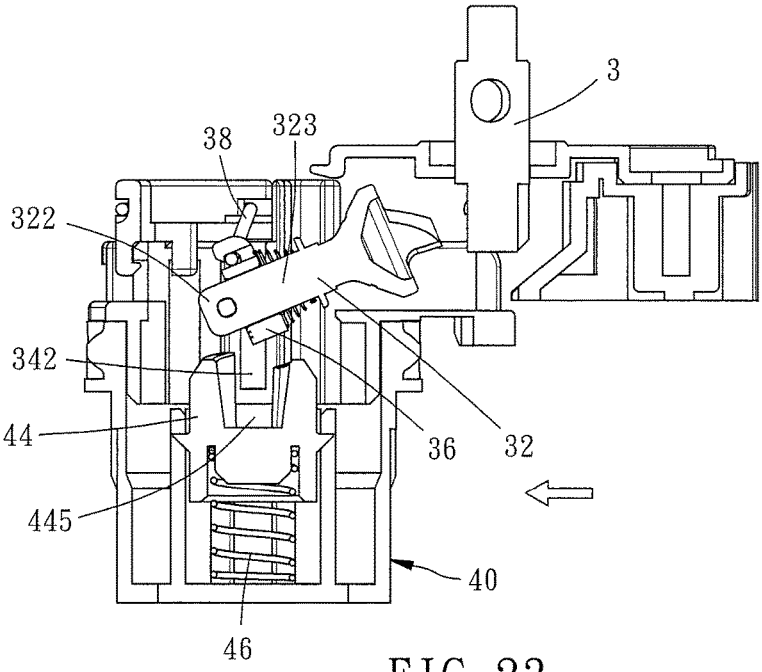
Figure 24:
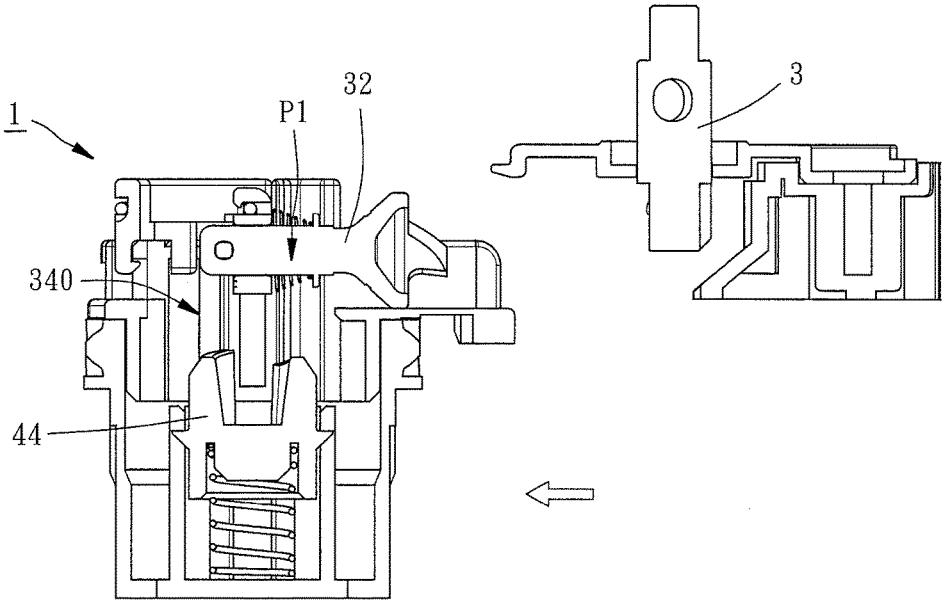

Refer to FIGS. 19-24, which show the process that the toner cartridge 1 is separated from the driving head 3 of the electronic imaging device 2 in the direction pointed by the arrow shown in FIGS. 19-24. The toner cartridge 1 may be separated from the driving head 3 in two different conditions. FIGS. 19-24 show the first condition that when the toner cartridge 1 is separated from the driving head 3, the swinging path of the coupling member 32 is not parallel to the direction the embedding groove 445 is extended, so the coupling member 32 can't start to swing from the second position P2. In such condition, the coupling member 32 should be moved away from the engaging member 44 approximately along the first imaginary axis L1 at first. Specifically speaking, the central recess 321*b* of the coupling member 32 is cone-shaped, and the position of the driving head 3 is unchanged. Therefore, when the toner cartridge 1 is moved to the left in FIG. 19, the inner wall of the central recess 321*b* is pressed by the driving head 3 at first. At this time, the space in the embedding groove 445 enables the coupling member 32 to swing a little bit to be abutted against one of the arched walls 448, as shown in FIG. 20. With the toner cartridge 1 continuously being moved to the left as shown in FIG. 21, the driving head 3 escapes from the central recess 321*b* and presses the main body 321*a* of the coupling member 32, causing the coupling member 32 to push the guiding end surfaces 449 of the engaging member 44 through the axle seat 36 and overcome the elastic force of the second elastic member 46, so that the coupling member 32, the axle seat 36 and the engaging member 44 are moved downwardly together. When the toner cartridge 1 is continuously moved to the left, the driving head 3 is separated from the coupling member 32, which means the coupling member 32 is no longer pressed by the driving head 3. As shown in FIGS. 22-23, the engaging member 44 is moved upwardly by the elastic force of the second elastic member 46 to push the axle seat 36 to move upwardly. At the same time, the elastic force of the first elastic member 38 causes the axle seat 36 to move away from the linking unit 40 by sliding along the two sliding grooves 342. After the rotary force transmitting portion 322 completely escapes from the embedding groove 445, the elastic force of the first elastic member 38 causes the axle seat 36 and the coupling member 32 to swing clockwise together, thereby causing the axial portion 323 of the coupling member 32 to leave the passage 340 and at last causing the coupling member 32 to move back to the first position P1, as shown in FIG. 24, so that the separation of the toner cartridge 1 from the driving head 3 is accomplished.

In the practical separation, the above-mentioned second condition may happen. That is the direction the embedding groove 445 is extended is parallel to the swinging path of the coupling member 32, and therefore the coupling member 32 can directly swing from the second position P2 to the first position P1. When the coupling member 32 starts to swing, the driving head 3 escapes from the central recess 321*b* at first. With the movement of the toner cartridge 1, the driving head 3 then pushes one of the engaging pillars 321*c* of the coupling member 32, causing the axle seat 36 to press the engaging member 44 toward the linking unit 40, so that the engaging member 44 overcomes the elastic force of the second elastic member 46 to move downwardly. With the coupling member 32 continuously swinging, the rotary force transmitting portion 322 gradually leaves the embedding groove 445, the engaging member 44 is no longer pressed by the axle seat 36 and moved upwardly by the elastic force of the second elastic member 46, the elastic force of the first elastic member 38 causes the axle seat 36 to move away from the linking unit 40 by sliding along the two sliding grooves 342 upwardly and also causes the axle seat 36 to swing clockwise together with the coupling member 32. At last, the coupling member 32 is moved back to the first position P1, and the separation of the toner cartridge 1 from the driving head 3 is accomplished.

As a result, no matter the toner cartridge 1 is installed into the electronic imaging device 2 or removed from the electronic imaging device 2, the toner cartridge 1 is connected with and separated from the driving head 3 easily and smoothly. Besides, when the toner cartridge 1 is not yet installed in the electronic imaging device 2 or not yet in contact with the driving head 3, the coupling member 32 located at the first position P1 is covered by the cover 34, thereby prevented from being hit or hooked by external objects, so that the toner cartridge 1 is lowered in the risk of being damaged.

Based on the spirit of the present invention, the structure of the toner cartridge 1 may be modified. For example, the structures of the connecting unit 30 and the linking unit 40 may be modified and unlimited to the structures described above. However, the coupling member 32 should be movable between the first position P1 and the second position P2. Besides, when the coupling member 32 is located at the first position P1, the second imaginary axis L2 is not parallel to the first imaginary axis L1, and the coupling member 32 is not in contact with the linking unit 40; when the coupling member 32 is located at the second position P2, the second imaginary axis L2 is coaxial with the first imaginary axis L1, and the coupling member 32 and the linking unit 40 are engaged with each other and rotatable together.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner cartridge comprising:

a housing provided therein with an accommodating space, an end of the housing having an opening communicating with the accommodating space and exterior of the housing;

a photosensitive drum accommodated in the accommodating space of the housing in a way that the photosensitive drum is rotatable about a first imaginary axis;

a connecting unit disposed on the opening of the housing and having a coupling member which is rotatable about a second imaginary axis; and a linking unit disposed on an end of the photosensitive drum and rotatable together with the photosensitive drum;

wherein the coupling member is movable between a first position and a second position; when the coupling member is located at the first position, the coupling member is not in contact with the linking unit; when the coupling member is located at the second position, the second imaginary axis is coaxial with the first imaginary axis, and the coupling member and the linking unit are engaged with each other and rotatable together.

2. The toner cartridge as claimed in claim 1, wherein when the coupling member is located at the first position, the second imaginary axis is not parallel to the first imaginary axis.

3. The toner cartridge as claimed in claim 2, wherein the connecting unit comprises a cover disposed on the opening of the housing, an axle seat movably and rotatably disposed on the cover, and a first elastic member disposed on the cover and connected with the axle seat; the coupling member is disposed on the axle seat and rotatable relative to the axle seat; the first elastic member applies a force to the axle seat to enable the coupling member to move back to the first position; the linking unit has a gear disposed on said end of the photosensitive drum, an engaging member disposed on the gear and movable along the first imaginary axis relative to the gear, and a second elastic member disposed between the gear and the engaging member; the second elastic member applies a force toward the connecting unit to the engaging member to enable the engaging member to be engaged with the coupling member located at the second position.

4. The toner cartridge as claimed in claim 3, wherein the cover is provided at a center thereof with a passage extended along the first imaginary axis; the coupling member has a rotary force receiving portion, a rotary force transmitting portion, and an axial portion connecting the rotary force receiving portion with the rotary force transmitting portion; the axle seat is provided at a center thereof with an axial hole; the axial portion of the coupling member is inserted through the axial hole; the axial portion of the coupling member located at the second position is inserted through the passage.

5. The toner cartridge as claimed in claim 4, wherein the first elastic member is elongated and spans the passage; two ends of the first elastic member are connected with the cover; a center of the first elastic member is connected with the axle seat.

6. The toner cartridge as claimed in claim 4, wherein the first elastic member is loop-shaped and has a noose portion and a spanning portion; the noose portion is put around the cover; the spanning portion spans the passage and is connected with the axle seat.

7. The toner cartridge as claimed in claim 6, wherein the axle seat has an accommodating groove accommodating the spanning portion of the first elastic member.

8. The toner cartridge as claimed in claim 6, wherein the cover has a main body and a sub-body connected with the main body; the sub-body is curved and located by the passage; the sub-body is provided on a periphery thereof with a groove; the noose portion of the first elastic member is put in the groove; the spanning portion of the first elastic member is bridged between two ends of the sub-body.

9. The toner cartridge as claimed in claim 4, wherein the cover has two sliding grooves provided on two sides of the passage; the axle seat is provided on two sides thereof with two protruded columns; the two protruded columns are inserted in the two sliding grooves to enable the axle seat to move and rotate relative to the cover.

10. The toner cartridge as claimed in claim 4, wherein the rotary force receiving portion of the coupling member comprises a main body which is cone-shaped, a central recess which is located on a side of the main body opposite to the axial portion, and two engaging pillars extended from said side of the main body opposite to the axial portion and located by two sides of the central recess.

11. The toner cartridge as claimed in claim 4, wherein the rotary force transmitting portion of the coupling member comprises a central axle connected with the axial portion, a radial hole passing through the central axle, and a pin inserted through the radial hole; two ends of the pin are protruded out of the radial hole.

12. The toner cartridge as claimed in claim 4, wherein the connecting unit further comprises a compressed spring sleeved onto the axial portion of the coupling member, and two ends of the compressed spring are abutted against the rotary force receiving portion and the axle seat.

13. The toner cartridge as claimed in claim 3, wherein the gear has an accommodating portion accommodating the engaging member and the second elastic member, and two elongated grooves provided on two sides of the accommodating portion; the engaging member has a main body, and two transmitting arms extended from two sides of the main body; the second elastic member is abutted against the main body; the two transmitting arms are inserted in the two elongated grooves to enable the engaging member to move along the first imaginary axis relative to the gear and disable the engaging member from rotating relative to the gear; the two elongated grooves are extended parallel to the first imaginary axis.

14. The toner cartridge as claimed in claim 13, wherein the main body of the engaging member has an embedding groove located on a side of the main body opposite to the second elastic member; the cover is provided at a center thereof with a passage; the coupling member has a rotary force receiving portion, a rotary force transmitting portion, and an axial portion connecting the rotary force receiving portion with the rotary force transmitting portion; the axle seat is provided at a center thereof with an axial hole; the axial portion of the coupling member is inserted through the axial hole; when the coupling member is located at the second position, the axial portion is inserted through the passage, and the rotary force transmitting portion is inserted in the embedding groove so that the coupling member and the engaging member are engaged with each other and rotatable together.

15. The toner cartridge as claimed in claim 14, wherein the main body of the engaging member has two arched walls located by two sides of the embedding groove; each of the arched walls has a guiding end surface facing the axle seat.

16. A transmission device of a toner cartridge, the transmission device comprising:

a connecting unit having a coupling member which is rotatable about a second imaginary axis; and a linking unit which is rotatable about a first imaginary axis;

wherein the coupling member is movable between a first position and a second position; when the coupling member is located at the first position, the coupling member is not in contact with the linking unit; when the coupling member is located at the second position, the second imaginary axis is coaxial with the first imaginary axis, and the coupling member and the linking unit are engaged with each other and rotatable together.

17. The transmission device as claimed in claim 16, wherein when the coupling member is located at the first position, the second imaginary axis is not parallel to the first imaginary axis.

18. The transmission device as claimed in claim 17, wherein the toner cartridge has a photosensitive drum; the linking unit is disposed on an end of the photosensitive drum; the photosensitive drum is rotatable about the first imaginary axis.

19. The transmission device as claimed in claim 18, wherein the toner cartridge has a housing which is provided therein with an accommodating space for accommodating the photosensitive drum; an end of the housing has an opening communicating with the accommodating space and exterior of the housing; the connecting unit is disposed on the opening.

20. The transmission device as claimed in claim 19, wherein the connecting unit comprises a cover disposed on the opening of the housing, an axle seat movably and rotatably disposed on the cover, and a first elastic member disposed on the cover and connected with the axle seat; the coupling member is disposed on the axle seat and rotatable relative to the axle seat; the first elastic member applies a force to the axle seat to enable the coupling member to move back to the first position; the linking unit has a gear disposed on said end of the photosensitive drum, an engaging member disposed on the gear and movable along the first imaginary axis relative to the gear, and a second elastic member disposed between the gear and the engaging member; the second elastic member applies a force toward the connecting unit to the engaging member to enable the engaging member to be engaged with the coupling member located at the second position.

21. The transmission device as claimed in claim 20, wherein the cover is provided at a center thereof with a passage extended along the first imaginary axis; the coupling member has a rotary force receiving portion, a rotary force transmitting portion, and an axial portion connecting the rotary force receiving portion with the rotary force transmitting portion; the axle seat is provided at a center thereof with an axial hole; the axial portion of the coupling member is inserted through the axial hole; the axial portion of the coupling member located at the second position is inserted through the passage.

22. The transmission device as claimed in claim 21, wherein the first elastic member is elongated and spans the passage; two ends of the first elastic member are connected with the cover; a center of the first elastic member is connected with the axle seat.

23. The transmission device as claimed in claim 21, wherein the first elastic member is loop-shaped and has a noose portion and a spanning portion; the noose portion is put around the cover; the spanning portion spans the passage and is connected with the axle seat.

24. The transmission device as claimed in claim 23, wherein the axle seat has an accommodating groove accommodating the spanning portion of the first elastic member.

25. The transmission device as claimed in claim 23, wherein the cover has a main body and a sub-body connected with the main body; the sub-body is curved and located by the passage; the sub-body is provided on a periphery thereof with a groove; the noose portion of the first elastic member is put in the groove; the spanning portion of the first elastic member is bridged between two ends of the sub-body.

26. The transmission device as claimed in claim 21, wherein the cover has two sliding grooves provided on two sides of the passage; the axle seat is provided on two sides thereof with two protruded columns; the two protruded columns are inserted in the two sliding grooves to enable the axle seat to move and rotate relative to the cover.

27. The transmission device as claimed in claim 21, wherein the rotary force receiving portion of the coupling member comprises a main body which is cone-shaped, a central recess which is located on a side of the main body opposite to the axial portion, and two engaging pillars extended from said side of the main body opposite to the axial portion and located by two sides of the central recess.

28. The transmission device as claimed in claim 21, wherein the rotary force transmitting portion of the coupling member comprises a central axle connected with the axial portion, a radial hole passing through the central axle, and a pin inserted through the radial hole; two ends of the pin are protruded out of the radial hole.

29. The transmission device as claimed in claim 21, wherein the connecting unit further comprises a compressed spring sleeved onto the axial portion of the coupling member, and two ends of the compressed spring are abutted against the rotary force receiving portion and the axle seat.

30. The transmission device as claimed in claim 20, wherein the gear has an accommodating portion accommodating the engaging member and the second elastic member, and two elongated grooves provided on two sides of the accommodating portion; the engaging member has a main body, and two transmitting arms extended from two sides of the main body; the second elastic member is abutted against the main body; the two transmitting arms are inserted in the two elongated grooves to enable the engaging member to move along the first imaginary axis relative to the gear and disable the engaging member from rotating relative to the gear; the two elongated grooves are extended parallel to the first imaginary axis.

31. The transmission device as claimed in claim 30, wherein the main body of the engaging member has an embedding groove located on a side of the main body opposite to the second elastic member; the cover is provided at a center thereof with a passage; the coupling member has a rotary force receiving portion, a rotary force transmitting portion, and an axial portion connecting the rotary force receiving portion with the rotary force transmitting portion; the axle seat is provided at a center thereof with an axial hole; the axial portion of the coupling member is inserted through the axial hole; when the coupling member is located at the second position, the axial portion is inserted through the passage, and the rotary force transmitting portion is inserted in the embedding groove so that the coupling member and the engaging member are engaged with each other and rotatable together.

32. The transmission device as claimed in claim 31, wherein the main body of the engaging member has two arched walls located by two sides of the embedding groove; each of the arched walls has a guiding end surface facing the axle seat.

* * * * *